US005083823A

United States Patent [19]

Fann et al.

[11] Patent Number: 5,083,823

[45] Date of Patent: Jan. 28, 1992

[54] LATCH BOLT OPERATING DEVICE WITH LEVER HANDLES AND IMPROVED PRIVACY LOCK MECHANISM

[75] Inventors: Yaw-Shin Fann; Ming-Shyang Chiou, both of Chia-Yi, Taiwan

[73] Assignee: Tong-Lung Metal Industry Co., Ltd., Taiwan

[21] Appl. No.: 736,478

[22] Filed: Jul. 26, 1991

[51] Int. Cl.[5] ..... E05C 1/16

[52] U.S. Cl. ..... 292/359; 292/150; 292/DIG. 26

[58] Field of Search ..... 292/359, 150, 169.12, 292/207, DIG. 26, 357, DIG. 60

[56] References Cited

U.S. PATENT DOCUMENTS 2,593,573 4/1952 Kalbersch ..... 292/150 X
2,721,092 10/1955 Simmons ..... 292/150 X
2,796,272 6/1957 Quinn ..... 292/207 X
3,241,872 3/1966 Moore ..... 292/207 X
4,861,084 8/1989 Ozagir et al. ..... 292/359

*Primary Examiner*—Richard E. Moore
*Attorney, Agent, or Firm*—Ladas & Parry

[57] ABSTRACT

A latch bolt operating device incorporating lever handles and rotary plates cooperatively rotatable with the lever handles to control the angle of the rotation of the handles. The device is provided with a simplified privacy lock mechanism to prevent the opening of a door at one side thereof. The lock mechanism is directly mounted to the assembly of the lever handles, thereby eliminating the need of an additional housing to hold the mechanism. One of the rotary plates is provided with a cam face to actuate a lock shaft of the lock mechanism. The lock shaft is telescopic so that the device accommodates door panels of different thickness.

5 Claims, 4 Drawing Sheets

LATCH BOLT OPERATING DEVICE WITH LEVER HANDLES AND IMPROVED PRIVACY LOCK MECHANISM

BACKGROUND OF THE INVENTION

1. Field of the Present Invention

This invention relates to a latch bolt operating device with lever handles, and particularly to one incorporating an improved privacy lock mechanism to prevent the opening of a door at one side thereof.

2. Brief Description of Prior Art

It is known that a privacy lock mechanism is provided in a latch bolt operating device with operating handle knob. It is also known that a privacy lock mechanism can be provided in a latch bolt operating device with operating lever handles. For example, U.S. Pat. No. 4,575,137 discloses a latch mechanism and an adaptor assembly which comprises a lock shaft that can be pressed at one side of a door to cause the shaft to lock the rotational movement of a lever handle at the other side and a cam mechanism to actuate the shaft to release the lever handle. The assembly disclosed therein is complicated because a housing in addition to a latch bolt housing is employed to hold the cam mechanism and the lock shaft.

SUMMARY OF THE INVENTION

An object of this invention is to provide a latch bolt operating device having lever handles and a privacy lock mechanism which is mounted directly to the lever handle assembly, thereby eliminating the need for an additional housing to hold the lock mechanism.

Another object of this invention is to provide a latch bolt operating device having lever handles and a simplified privacy lock mechanism which is adjustable in length so that the device accommodates door panels of different thickness.

According to one aspect of this invention, a latch bolt operating device to be mounted on a door comprises a pair of inside and outside mounting caps, an inside lever handle mounted to the inside mounting cap, an outside lever handle mounted to the outside mounting cap, a spring-loaded first rotary plate mounted to the inside lever handle to cooperatively rotate therewith, the first rotary plate having first radial projections, a spring-loaded second rotary plate mounted to the outside lever handle to cooperatively rotate therewith, the second rotary plate having second radial projections, and means for limiting the rotational movement of the first and second rotary plates as well as the inside and outside lever handles, provided in the inside and outside caps to engage the first and second radial projections. The device is characterized by: said inside and outside mounting caps which, respectively, have first and second axial through-holes offset from the axes of said inside and outside lever handles at distances that said first and second radial projections can reach. The device is further characterized by a locking shaft mounted to the inside and outside mounting caps, and a cam member provided on the first rotary plate. The locking shaft has a first end provided with a push button, a stepped section adjacent to the first end and passing through the first axial through-hole, and a second end movably extending into the second axial through-hole. The push button is operable to move the locking shaft to engage one of the second radial projections so as to restrict the rotation of the outside lever handle. The stepped section has an annular shoulder being movable inwardly or outwardly of said first axial through-hole. The cam member is used to move the locking shaft to disengage from said second radial projection and formed on one of the first radial projections to so as to cam said annular shoulder to move into said first axial through-hole when said first rotary plate is rotated.

The present exemplary preferred embodiment will be described in detail with reference to the accompanying drawings, in which:

DETAILED DESCRIPTION OF THE PREFERRED EMBODIMENT

Figure 1:
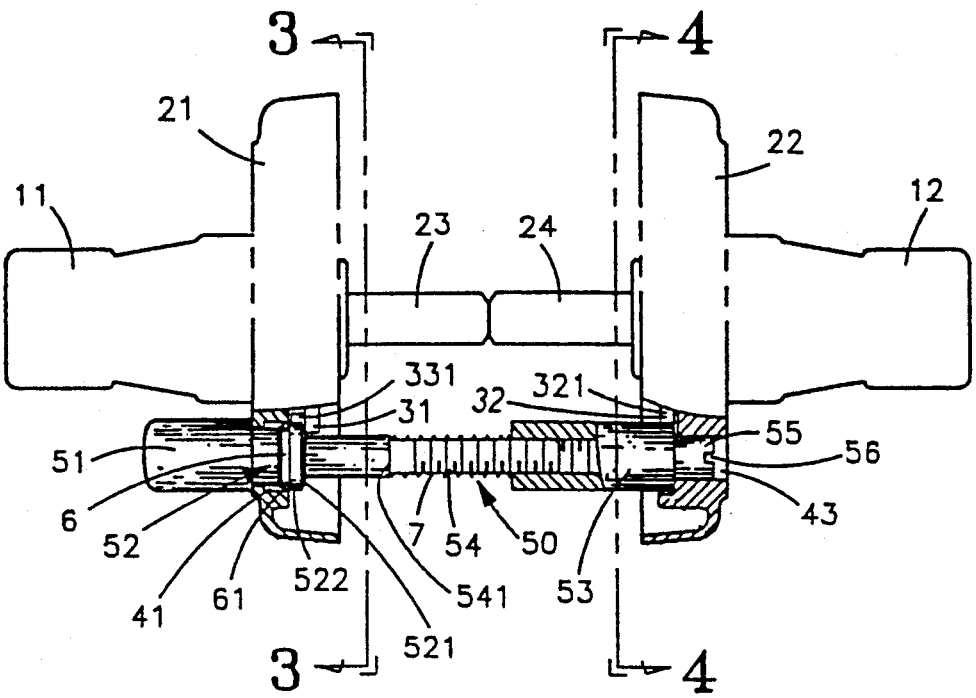
FIG. 1 illustrates a latch bolt operating device according to this invention.

A preferred embodiment of a latch bolt operating device incorporating this invention is shown in FIG. 1. The device comprises a pair of inner and outer lever handles 11 and 12 to be mounted on two sides of a door (not shown) by means of mounting caps 21 and 22. The handles 11 and 12 are respectively provided with spindles 23 and 24 to operate a latch bolt (not shown) to lock or unlock the door.

Figure 2:
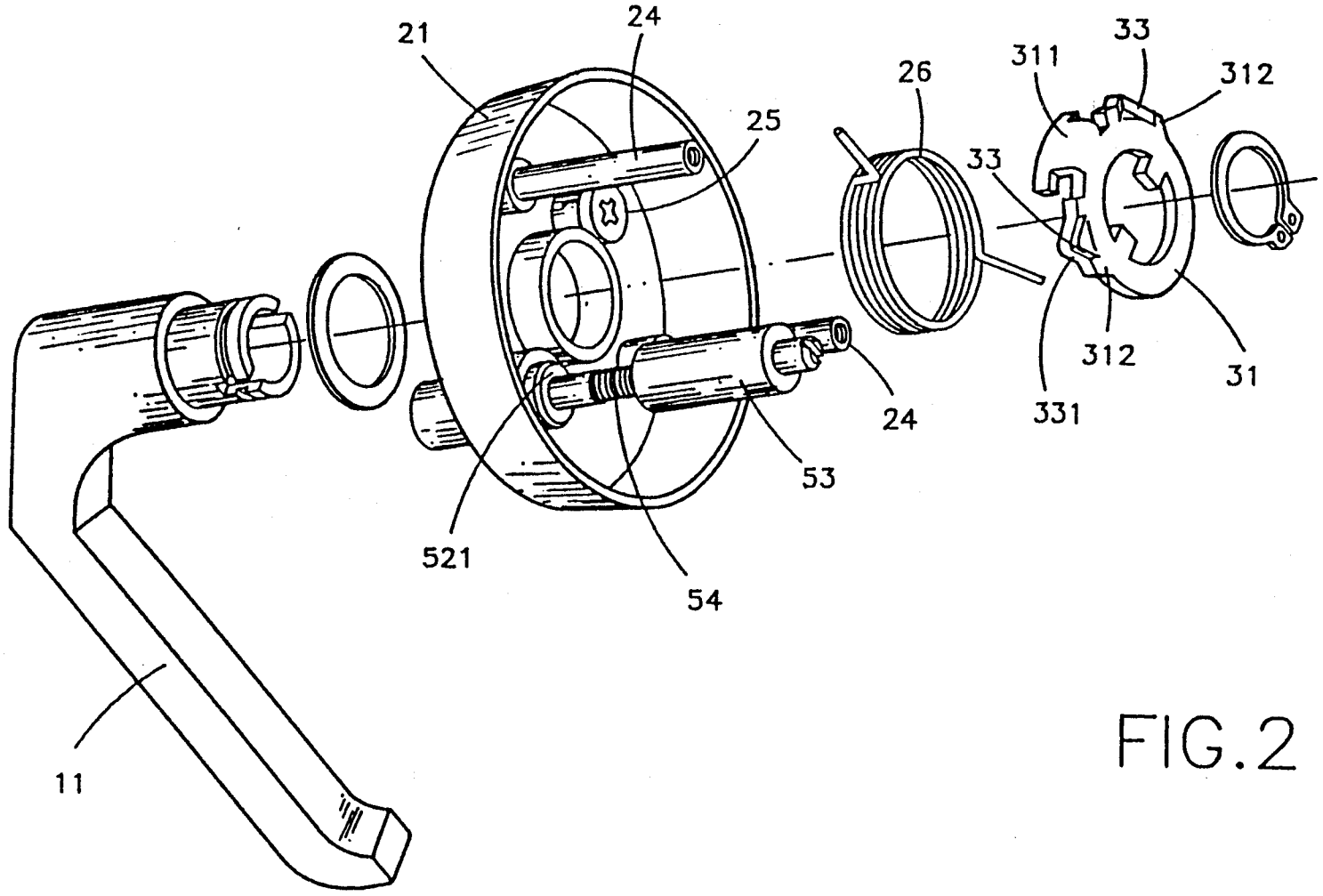
FIG. 2 is an exploded view showing the assembly of one of the lever handles and one of the mounting caps shown in FIG. 1.

As shown in FIG. 2, the cap 21 is provided with two fasteners 24 used to fix the cap 21 to the door, a rotary plate 31 rotatable with the spindle 23 and loaded with a torsion spring 26, and a stud 25 to stop the rotation of one of the radial projections 312 of the rotary plate. The torsion spring 26 has one end abutting against one of the fasteners 24 and the other end engaging a radial projection 311 of the rotary plate 31 so that the handle 11 can return to its original position after it is turned a certain angle. The construction of the handle 12 and that of the mounting cap 22 are substantially similar to that of the handle 11 and the cap 21. A rotary plate 32 substantially similar to the rotary plate 31 is mounted on the lever handle 12 of the mounting cap 22. U.S. patent application No. 07,632,139 which was filed by the same applicant on Dec. 21, 1990 discloses such a latch bolt device. In this invention, the rotary plate 31 which is connected to the inside lever handle 11 is provided with a cam member 33 on each radial projection 312 of the rotary plate. Both caps 21 and 22 are respectively provided with axial through-holes 41 and 43 which are offset from the axes of the lever handles 11 and 12 respectively.

A telescopic locking shaft which extends from one of the caps 21 to the other cap 22 is constituted by a rod 50 and a sleeve 53 threadedly sleeved on a portion of the rod 50. The sleeve 53 has a constricted end 55 inserted in the hole 43 of the cap 22. The rod 50 has a push button 51 extending outwardly of the cap 21, a stepped section 52 passing through the hole 41 of the cap 21 and a threaded section 54 partially extending into the sleeve 53. The end face of the constricted end 55 of the sleeve 53 is provided with a screw driver engaging groove 56 so that the sleeve 53 can be turned from the outside of the hole 43 and that the length of the telescopic locking shaft can be adjusted to accommodate door panels of different thickness. A helical compression spring 7 is sleeved on the threaded section 54 between the distal end of the sleeve 53 and a shoulder 541 of the threaded section 54.

The stepped section 52 has a first section 522 of larger cross-section and a second section of smaller cross-section forming an annular shoulder formation 521 therebetween. The stepped section 52 is further provided with an annular groove 6 in the first section 522 to receive a resilient C-shaped lock ring 61 which contacts frictionally with the wall confining the axial through-hole 41.

Figure 3:
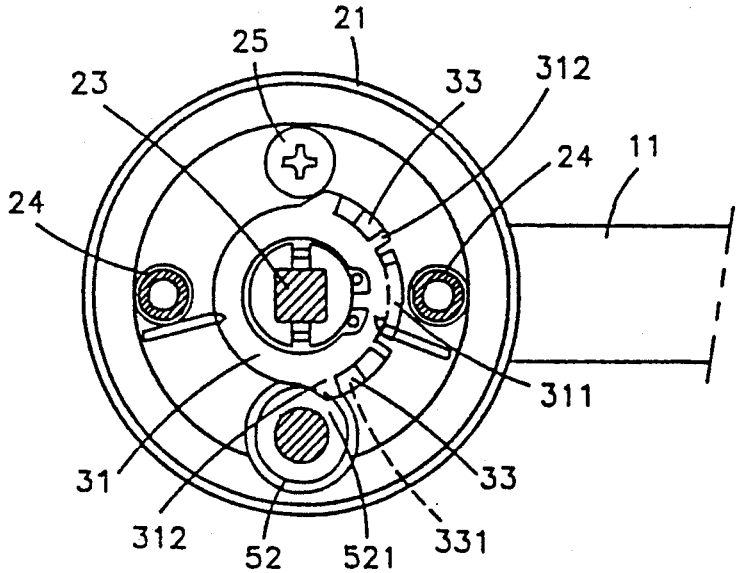
FIG. 3 is a sectional view taken from line 3—3 of FIG. 1.
Figure 4:
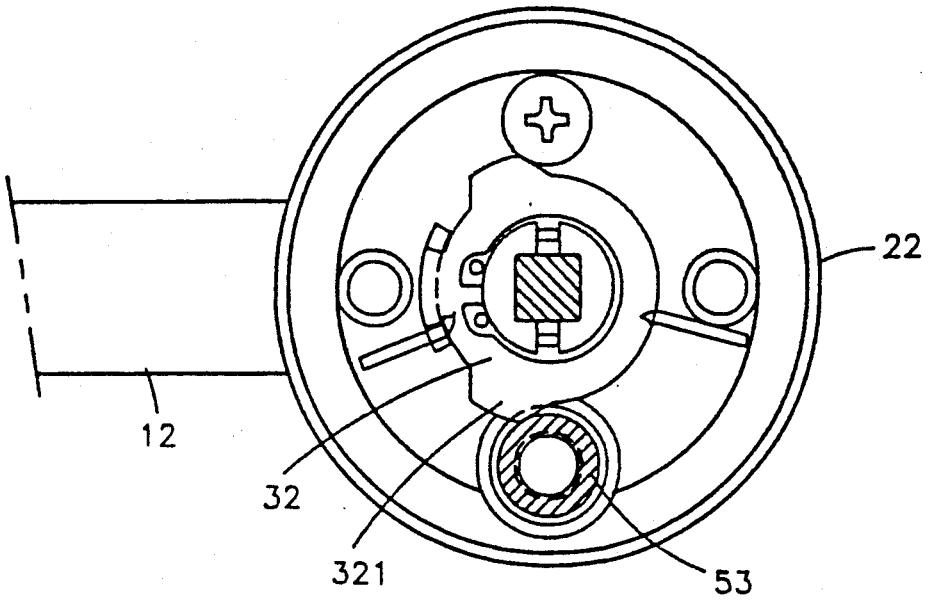
FIG. 4 is a sectional view taken from line 4—4 of FIG. 1.

When the push button 51 is pressed until it abuts with the mounting cap 21 shown in FIG. 1, the locking shaft moves inwardly of the mounting cap 21 until the annular shoulder 521 extends outwardly of the hole 41. The locking shaft is retained in this position because of the friction between the resilient lock ring 61 and the wall of the hole 41. In this situation, one of the radial projections 312 is adjacent to the annular shoulder 521 as shown in FIG. 3. The constricted end 55 of the locking shaft enters completely the through-hole 43 of the cap 22 so that the rotary plate 32 of the lever handle 12 is engaged with the sleeve 53 which is larger in cross-section than the constricted end 55, as shown in FIGS. 1 and 4, and thus is prevented from rotating.

Figure 5:
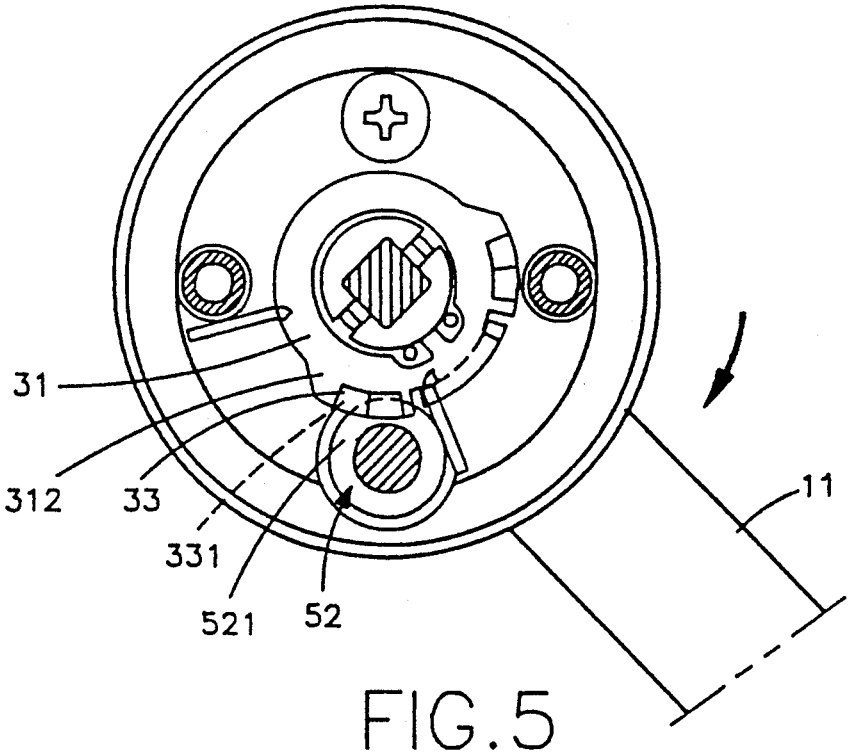
FIG. 5 is a section view also taken from line 3—3 of FIG. 1 but in a different position.
Figure 6:
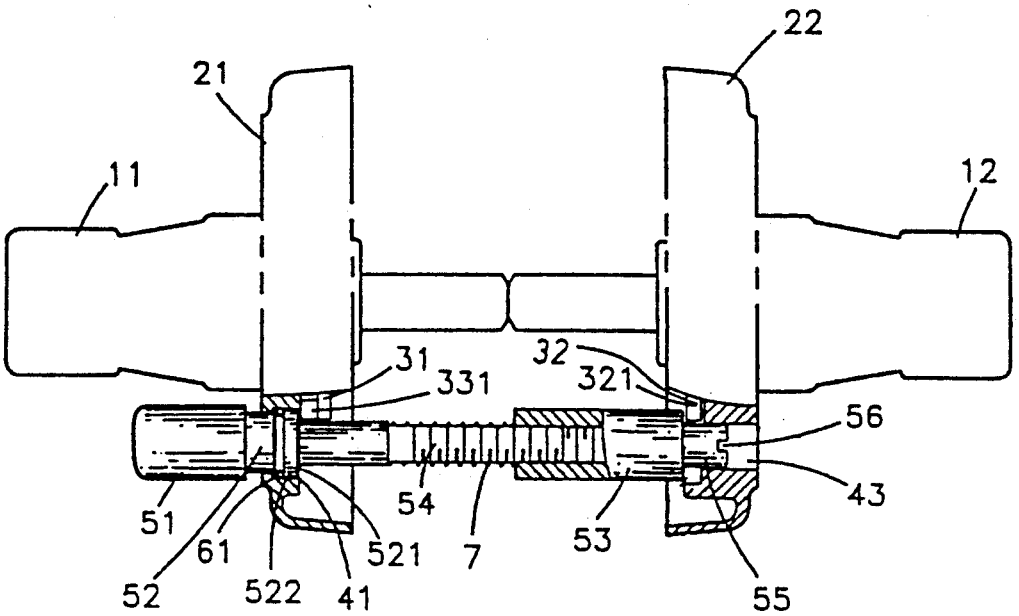
FIG. 6 shows the device of FIG. 1 but in a different position.

The cam member 33 is a protrusion projecting axially from the radial projection 312 of the rotary plate 31 toward the annular shoulder 521. The cam member 33 has an inclined faces 331 which extend axially and circumferentially relative to the rotary plate 31. When the lever handle 11 is rotated, the inclined face 331 cams the shoulder formation 521 of the stepped section 52, as shown in FIG. 5, thereby moving the annular shoulder 521 into the axial hole 41 and moving outward the push button 51. As the result, the constricted end 55 moves partially out of the hole 43, as shown in FIG. 6, and permits the projection 321 of the rotary plate 32 to move past the exposed part of the constricted end 55 and permits the lever handle 12 to rotate.

Figure 7:
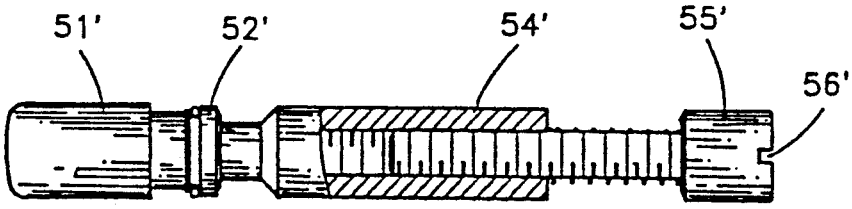
FIG. 7 shows an alternative of the lock shaft of this invention.

FIG. 7 shows an alternative to the telescopic shaft of this invention in which the push button 51′ and the stepped section 52′ are connected to the sleeve 54′ and the threaded rod thereof is connected to an enlarged end 55′ with a screw driver engaging groove 56′. The enlarged end 55′ extends into the through-hole 43 of the cap 22 and engages the rotary plate 32 only when the push button 51′ is depressed. When the push button 51′ is moved away from its depressed position, the enlarged end 55′ is moved out of the through-hole 43 until it disengages from the radial projection 321 of the rotary plate 32.

With the invention thus explained, it is apparent that various modifications and variations can be made without departing from the scope of this invention. It is therefore intended that this invention be limited only as indicated in the appended claims.

What I claim is:

1. A latch bolt operating device to be mounted on a door comprising a pair of inside and outside mounting caps to be mounted on two opposite sides of the door, an inside lever handle having an axis mounted to said inside mounting cap, an outside lever handle having an axis mounted to said outside mounting cap, a spring-loaded first rotary plate mounted to said inside lever handle in said inside mounting cap to cooperatively rotate therewith, said first rotary plate having first radial projections, a spring-loaded second rotary plate mounted to said outside lever handle in said outside mounting cap to cooperatively rotate therewith, said second rotary plate having second radial projections, means for limiting the rotational movement of said first and second rotary plates as well as said inside and outside lever handles, provided in said inside and outside caps to engage said first and second radial projections, characterized by:

said inside and outside mounting caps respectively having first and second axial through-holes offset from said axes of said inside and outside lever handles at distances that said first and second radial projections can reach;

a locking shaft having a first end provided with a push button, a stepped section adjacent to said first end and movably passing through said first axial through-hole, and a second end movably extending into said second axial through-hole, said push button being operable to move said locking shaft to engage one of said second radial projections so as to restrict the rotation of said outside lever handle, said stepped section having an annular shoulder being movable inwardly or outwardly of said first axial through-hole;

means for moving said locking shaft to disengage from said one of said second radial projections, incorporated into said first rotary plate, said means having a cam member formed on at least one of said first radial projections to cam said annular shoulder to move into said first axial through-hole when said first rotary plate is rotated.

2. A latch bolt operating assembly as claimed in claim 1, wherein said locking shaft is telescopic and comprises a rod with a threaded section and a sleeve threadedly sleeved onto said threaded section, said second end of said locking shaft being provided with a screw driver engaging end face, thereby permitting adjustment of the length of said locking shaft from the outside of said second axial through-hole.

3. A latch bolt operating device as claimed in claim 2, wherein said second end is a constricted end inserted into said second axial through-hole of said outside mounting cap.

4. A latch bolt operating device as claimed in claim 1, wherein said stepped section further has a peripheral annular groove and a resilient C-shaped lock ring received in said annular groove, said resilient lock ring frictionally contacting the wall confining said first axial through-hole of said inside mounting cap.

5. A latch bolt operating device as claimed in claim 1, wherein said cam member is a protrusion projecting axially from said one of said first radial projections toward said annular shoulder and having an inclined face extending axially and circumferentially relative to said first rotary plate.

* * * * *